US005655689A

United States Patent [19]

Fuchs et al.

[11] Patent Number: 5,655,689

[45] Date of Patent: Aug. 12, 1997

[54] MEDIA DISPENSER HAVING A VARIABLE CONSTRICTION OUTLET

[75] Inventors: Karl-Heinz Fuchs; Stefan Ritsche, both of Radolfzell, Germany

[73] Assignee: Ing. Erich Pfeiffer GmbH & Co. KG, Radolfzell, Germany

[21] Appl. No.: 433,763

[22] Filed: May 4, 1995

[30] Foreign Application Priority Data

May 19, 1994 [DE] Germany ..... 44 17 486.1

[51] Int. Cl.[6] ..... B65D 88/54

[52] U.S. Cl. ..... 222/321.3; 222/321.2; 222/548

[58] Field of Search ..... 222/321.2, 321.9, 222/321.7, 548, 321.3

[56] References Cited

U.S. PATENT DOCUMENTS

| | | |
|---|---|---|
| 3,240,399 | 3/1966 | Frandeen . |
| 5,265,771 | 11/1993 | Meshberg . |
| 5,289,818 | 3/1994 | Citterio et al. . |

FOREIGN PATENT DOCUMENTS

| | | |
|---|---|---|
| 270676 | 6/1988 | European Pat. Off. . |
| 486894 | 5/1992 | European Pat. Off. . |
| 2644786 | 4/1977 | Germany . |
| 8423550 | 8/1984 | Germany . |
| 8621135 | 8/1986 | Germany . |
| 3545409 | 7/1987 | Germany . |
| 3715300 | 11/1988 | Germany . |
| 9108334 | 7/1991 | Germany . |
| 4008070 | 9/1991 | Germany . |
| 4027320 | 3/1992 | Germany . |
| 4209954 | 9/1993 | Germany . |
| WO91/15303 | 10/1991 | WIPO . |

*Primary Examiner*—Gregory L. Huson
*Attorney, Agent, or Firm*—Quarles & Brady

[57] ABSTRACT

A discharge apparatus provided as a single spray has in the interior of the discharge connection as an evaporation barrier for the medium a rotary closure, which can be opened and closed by a mutual rotation of the casing and the head or the body and the medium reservoir. For this purpose a shaft part in the form of a filler is formed from two longitudinally, interconnected bar parts, which rotatably engage in one another and form closure parts of the closure located within a cover sleeve. This allows very long storage times of the filled discharge apparatus.

34 Claims, 3 Drawing Sheets

MEDIA DISPENSER HAVING A VARIABLE CONSTRICTION OUTLET

BACKGROUND OF THE INVENTION

The invention relates to a discharge apparatus for media, particularly for media, whose solvents or constituents are in part or totally volatile to slightly volatile, e.g. have a tendency to evaporate, dry out, etc. Such discharge apparatuses appropriately have a discharge actuation mechanism, which in the case of flowable, e.g. liquid media can be a pump, or a medium reservoir charged by a propellant or the like, etc. As in the case of a pump, the medium reservoir can directly form the pressure or pump chamber, which is or is not refillable by aftersuction or the like, so that it e.g. contains the complete supply of a medium for the discharge apparatus and can optionally be emptied with a single actuation process. The discharge apparatus can include the pressure chamber or medium reservoir or can be provided for subsequent fixing thereto, so that it only forms a discharge head with a medium inlet and a medium outlet.

In order to attain long, use-free storage periods for the discharge apparatus without any risk of the medium volatilizing, being contaminated from the outside by germs, dirt, etc., or by undergoing changes to its characteristics through the penetration of air or the like, it is possible to provide various closures which hermetically seal against pressure higher than atmospheric pressure, e.g. using closure membranes to be perforated or torn, valves to be opened by the discharge pressure of the medium, closure mandrels to be inserted in the medium outlet, etc., such closures either being reclosable by an inherent resiliency or can only be transferred from the closed into the open position, in which they are then secured by a holding force, without it being possible to return to the closed position without a functionally disturbing action in the discharge apparatus.

OBJECTS OF THE INVENTION

An object of the invention is to provide a discharge apparatus for media through which it is possible to avoid the disadvantages of known constructions and/or of the described type or actions of the indicated type, whilst in particular without any need for actuating a discharge process permitting in easily visible manner an actuation of the closure or making it visible from the outside in which position the closure is located.

SUMMARY OF THE INVENTION

According to the invention, at least on the inlet side, the closure is connected to a passage cross-section, which is much smaller than the largest internal cross-section of the medium reservoir, pressure chamber or pump chamber positioned transversely to the discharge direction, the closure being transferable from the closed into the open position and/or vice versa without initiating or performing the discharge process by means of a mechanical or not by a fluid transferred opening force. Thus, the closure can at any time be opened or reclosed substantially independently of any actuation of the discharge apparatus, without the medium being exposed to a possibly harmful opening pressure and without the closure automatically closing again with a decrease in the medium pressure. The closure to be set in continuous manner can therefore be secured in self-holding manner in each of its positions and transferred from the latter into any other position and appropriately one, two or more positions are secured by positive stop action, a resilient locking means which can be overcome in one or two opposite directions, etc. The stop positions can e.g. be a completely closed position and a fully opened position with maximum passage cross-section. Instead of this or in addition thereto it is possible to provide an indicator indicating the position and detectable by a glance from the outside on the discharge apparatus, e.g. by a marking, or by a handle acting as an indicator used for actuating the closure. It is also possible to provide a frictionally and/or positively acting lock, which only permits an actuation of the discharge process if the closure is wholly or partly opened.

It is particularly advantageous if the closure is provided in an outlet channel connecting longitudinally to the medium reservoir and whose greatest width is smaller than half or a third of the cross-sectional width of the medium reservoir, so that by the capillary channel-like constriction of the outlet channel a closure-like action is provided in such a way that even in the case of a downwardly directed outlet opening located at the lower end of the outlet channel an outflow of the medium would not be possible. The width of the outlet channel can be less than 3, 2 or ½ mm, which also applies for the passage cross-sections of the closure. Thus, a running out without delivery pressure is not possible with the closure open. The medium reservoir is appropriately so positioned that in it and on increasing its space volume in the case of a closed closure or emptying from the medium outlet a vacuum would be produced. The closure can form the single valve of the discharge apparatus, so that there is no need for additional admission and/or delivery valves.

It is possible to actuate the closure with a linear actuating movement roughly parallel to the discharge actuation and directed in the same or opposite directions, but it is particularly advantageous if this actuating movement diverges from the discharge actuation, e.g. is at least partly or exclusively a pivoting or rotary movement. In this case there is no need for the closure to be so fixed by locking action, as would be conceivable, in the particular end position in such a way that the actuating force for the discharge actuation does not lead to an adjustment of the closure. The axial position of the closure handles or closure parts is consequently not changed by the closure actuation.

In simple manner the closure can be formed by two shaft parts connected to one another in the longitudinal direction and having roughly the same external width, whereof one carries a slide positionally variable in the medium reservoir in positionally rigid manner or displaceably carries the medium reservoir, whereas the other is immediately adjacent to the inner end of a nozzle end channel, which is bounded in one piece from said inner end to its outer end forming the medium outlet. As from the medium outlet the medium to be discharged is completely detached from the discharge apparatus in the form of an atomizing cone, droplet, foam strand, powder mist, spray jet, etc.

The construction according to the invention is particularly suitable for one-way or disposable dosing devices from which with a single discharge stroke or several such strokes in the same direction and without intermediate return strokes the complete stored supply of medium is discharged and then the discharge apparatus can be disposed of and is only suitable for the recovery of its materials or for the replacement of the medium reservoir by a full, new medium reservoir. The discharge apparatus appropriately has a cup-shaped casing, which at its front side remote from the discharge opening is open to the full cup width or on said front side is closed with an oppositely open, cup-shaped casing part, whereas the other front side is closed with a front wall or forms a discharge actuation handle. Over said front side projects a discharge head which is much narrower than the cup casing and which is e.g. substantially axially or rotationally symmetrical, in which the closure is located and which is traversed by the medium outlet at its outermost end face.

For actuating the closure the discharge head, the medium reservoir, etc. can be moved relative to the casing.

BRIEF FIGURE DESCRIPTION

These and further features can be gathered from the claims, description and drawings and the individual features, either singly or in the form of subcombinations, can be implemented in an embodiment of the invention and in other fields and can represent advantageous, independently protectable constructions for which protection is hereby claimed. Embodiments of the invention are described in greater detail hereinafter relative to the drawings, wherein show:

FIG. 1 A perspective view of a discharge apparatus.

FIG. 2 A discharge apparatus according to FIG. 1 in axial section and slightly modified construction.

FIG. 3 A detail of FIG. 2 on a much larger scale and slightly modified construction.

FIG. 4 A detail of another embodiment in perspective view.

DETAILED DESCRIPTION OF PREFERRED EXAMPLE EMBODIMENTS

Figure 1:
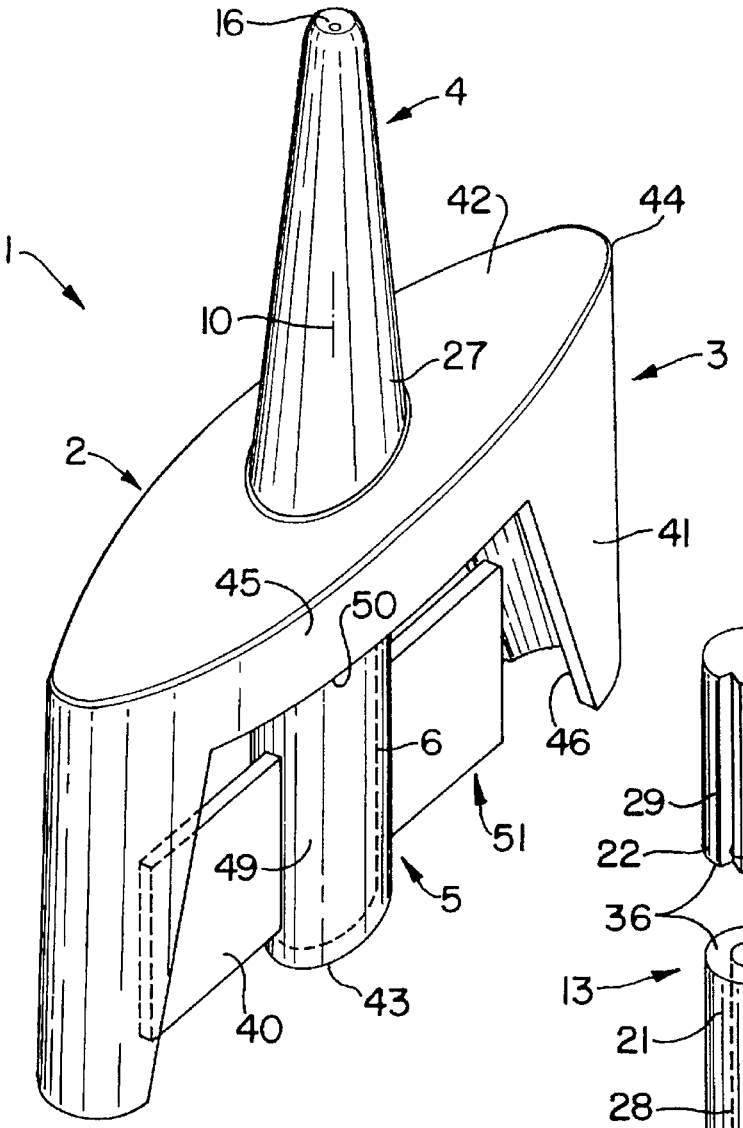

The discharge apparatus 1 has a one-piece or multipart body 2 with a maximum width casing 3 and a minimum width, axially directly connected discharge head 4, which together define the total axial extension of the discharge apparatus 1. Within the casing 3 are provided a thrust piston pump 5 and a one-piece medium reservoir 6 made from glass or a material with similar characteristics, particularly with regards to maintaining sterile. The elongated, cylindrical jacket 7 of the medium reservoir 6 at its outermost end passes in one-piece manner into an opening-free, pressure-tight closed bottom and forms at the end remote therefrom a container opening 9, which is at least as wide as the through, cylindrical inner Circumference of the jacket 7. All said arrangements and components are located in the central axis 10 of the discharge apparatus 1 and are constructed substantially axially or rotationally symmetrical thereto.

The inner circumference of the medium reservoir 6 serves as a cylinder working surface for the piston 11 of the pump 5 and for its displaceable, pressure-tight engagement of the piston 11 on the outer circumference has one or more piston lips 12 projecting in ring-like manner constructed in one piece with the piston 11. The space between the free front face of the piston 11 and the bottom 8 serves as a pump chamber, as well as as a prefilled, pressure-tight, sterile storage space for the medium which is closed against evaporation.

To the other end of the piston 11 is connected an elongated piston shaft 13 not exceeding the width of the reservoir 6 and much longer than the latter, which extends from the interior of the casing 3 to approximately the free end of the discharge head 4 and is secured in axially positionally rigid manner with respect thereto. The shaft 13 is traversed by a substantially linear outlet channel 14 from the storage space to the end of the discharge head 4 and is connected by a medium inlet 15 to the storage zone and at the other end issues freely outwards in a medium outlet 16. The body 2 has a carrying member 17 for the piston shaft constructed in one piece with the casing 3 and projecting freely into its interior oppositely to the head 4 and surrounds the shaft over its entire length in sleeve-like, closely engaging manner on the outer circumference and in the starting position in the reservoir 6 projects approximately up to the first piston lip 12 in order to centre the reservoir 6 against tilting movements. The outermost end of the carrying sleeve 17 passes with axial spacing from the casing 3 within the head 4 into a ring disk-like front wall of an outer cap 18, whose jacket surrounds it with radial spacing and passes with its end in one piece onto the associated, closed front wall of the cap 19 of the casing 3. The cap 18 is shorter than the carrying sleeve 17 and does not project into the casing interior.

Within the head 4, which is roughly of the same length but is much more slender than the casing 4 is provided a valve-like closure 20 for the outlet channel 14, which is formed by two closure parts 21, 22 manually rotatable against one another about the axis 10. The closure part 21 is constructed in one piece with a shaft part or channel portion 23 of the shaft 13, which by press fit traverses in positionally fixed manner and axially and rotationally secured the carrying sleeve 17, is constructed in one piece with the piston 11 or closure part 2i up to the free front face of the piston 11 and forms with the carrying sleeve 17 the only associated longitudinal portion of the shaft 13. The closure part 22 is partly constructed in one piece with a shaft part 24 directly axially connected to the shaft part 23 and which extends approximately to the free end of the head 4 or the channel 14. The shaft part 24 has a carrying part 26 constructed in one piece with the head 4 for a channel portion or a core body 25, on whose outer circumference engages closely with press fit over the entire length the carrying sleeve 26, so that the core body 25 is connected in axially and rotationally secured manner to the head 4.

The elongated core body 25 is shorter than the shaft part 23 and has roughly the same width as the latter. The elongated part 26 projects freely against the front wall of the outer cap 18 and ends at a limited distance therefrom, so that it rotatably surrounds in closely engaging manner on the outer circumference the associated end of the shaft part 23. The parts 21, 22 of the closure 20 are located fully within the associated end of the carrying sleeve 26, but components 23, 25 can also be referred to as closure parts.

As the inner sleeve 26 the carrying part is located with radial spacing within an outer jacket 27 conically widened relative to the casing 3 and which forms the outermost, exposed outer circumference of the head 4, no components engaging in the annular space between the jackets 26, 27. The shaft part 23 is traversed in bore-like manner between two ends or up to the front face of the piston 11 by a single channel portion 28 located in the axis 10 and whose widest end forms the medium inlet 15 and which passes out again with its narrowest width at the end face of the closure part 21. The channel portion 28 can be slightly tapered in step-free manner in the flow direction and has an average width of approximately 1 mm. The shaft part 24 is traversed by a portion 29 of the channel 15 connected by means of the closure 20 to the channel portion 28 and which over the entire length of the core body 25 passes as a longitudinal channel radially displaced with respect to the axis 10 and with a constant width smaller than that of the channel portion 28 and can be formed by a longitudinal groove on the outer circumference of the core body 25 or on the inner circumference of the sleeve 26, so that it is cross-sectionally limited by the two elements 25, 26.

Like the shaft part 23 the core body 25 is rod-like, but can be constructed as a filler completely located within the sleeve 26 and whose end associated with the medium outlet 16 forms a component of a flow control 30, through which the medium flow, shortly before leaving the medium outlet 16, is exposed to a desired flow influencing, e,g. a whirling, a twisting rotation about the starting axis, an impact atomization, etc. The medium outlet 16 is formed by the outer end of a nozzle end channel traversing a one-piece front wall of the head 4 and whose length approximately corresponds to its greatest width and forms an atomizing nozzle. The planar front face 31 of the filler 25 is immediately adjacent to the planar inside of the front wall, which can be in contact therewith. In one or both front faces 31 can be provided recessed flow channels of the control 30 and a transverse channel 32, which is radially or tangentially connected by its radially inner end to the ax ally inner end of the nozzle end channel, whilst its radially outer end is connected in angular manner to the axially outer end of the channel portion 29. The shaft part 23 can have a constant external width from the rearmost sealing member 20 of the piston 11 up to the closure part 21 and the channel portion 25 has over its entire length a constant and roughly the same external width as the shaft part 23.

The cylindrical closure part 21 having a continuous nature over its length has a reduced external width compared with the cylindrical shaft parts 23, 25 and for forming a pivot bearing engages over its entire length in a blind hole 37 in the associated end of the filler 25 in such a way that it engages with its planar end face 36 on the planar bottom face of the opening 37. The planar, ring-like shoulder and front face 35 which, projecting at the outer circumference of the closure part 21, forms the transition to the remaining shaft part 23 engages in substantially pressure-tight manner on the outermost end face of the parts 22, 25. Correspondingly the cylindrical outer circumference of the closure part 21 engages over its entire length in pressure-tight manner on the cylindrical inner circumference of the opening 37, so that the end of the channel portion 28 passing out at the front face 36 is sealed by means of a type of labyrinth packing. The latter is supplemented by an end portion 38 of the sleeve 26 projecting over the shoulders 35 and which surrounds in pressure-tight and closely engaging manner approximately up to the outer cap 18 the outer circumference of the shaft part 23 and forms an outer pivot bearing 39 for connecting the two shaft parts 23, 24. The channel portion 29 extends up to the associated end face 35 of the filler 25. The external width of the shaft part 23, according to FIG. 2, can be slightly larger than that of the filler 25, so that the shoulders 35 can also be supported axially on an inner shoulder of the sleeve 26 and in rotary manner with respect to the end face of the filler 25.

The jacket of the sleeve-like closure part 21 is traversed by a passage 23, which passes in the form of a longitudinal slit up to the end face 36, but is spaced from the transition face 35. Correspondingly the jacket of the sleeve-like closure part 22 is traversed by a longitudinal slit or passage 34, which passes through to the associated end face 35, but is spaced from the bottom face 36, so that the two closure part passages 33, 34 overlap one another only over a part of their particular axial extension and in the case of congruent orientation together define a medium passage closed over the circumference and whose passage cross-section is smaller than that of the openings 33, 34.

Figure 2:
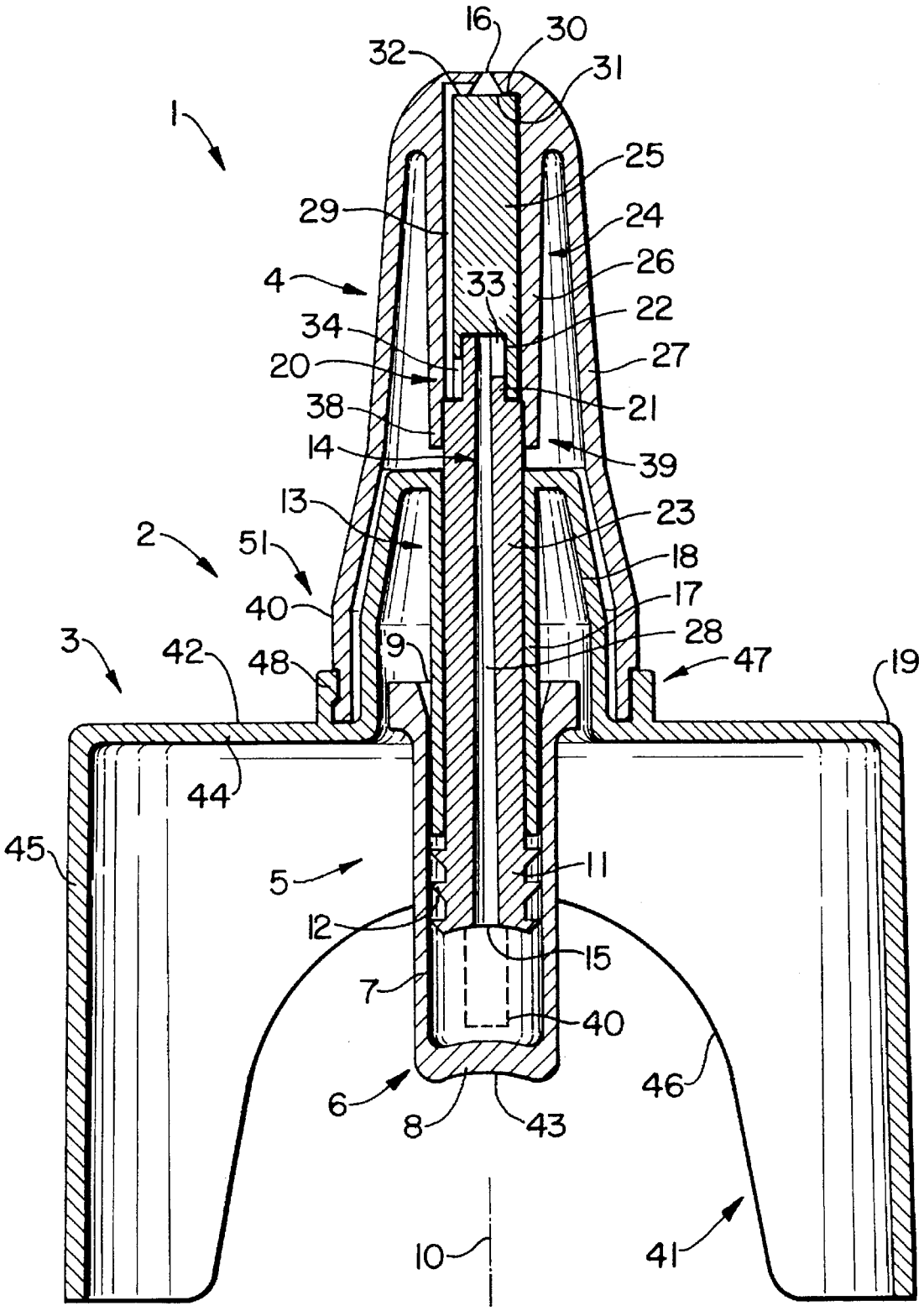
Figure 3:
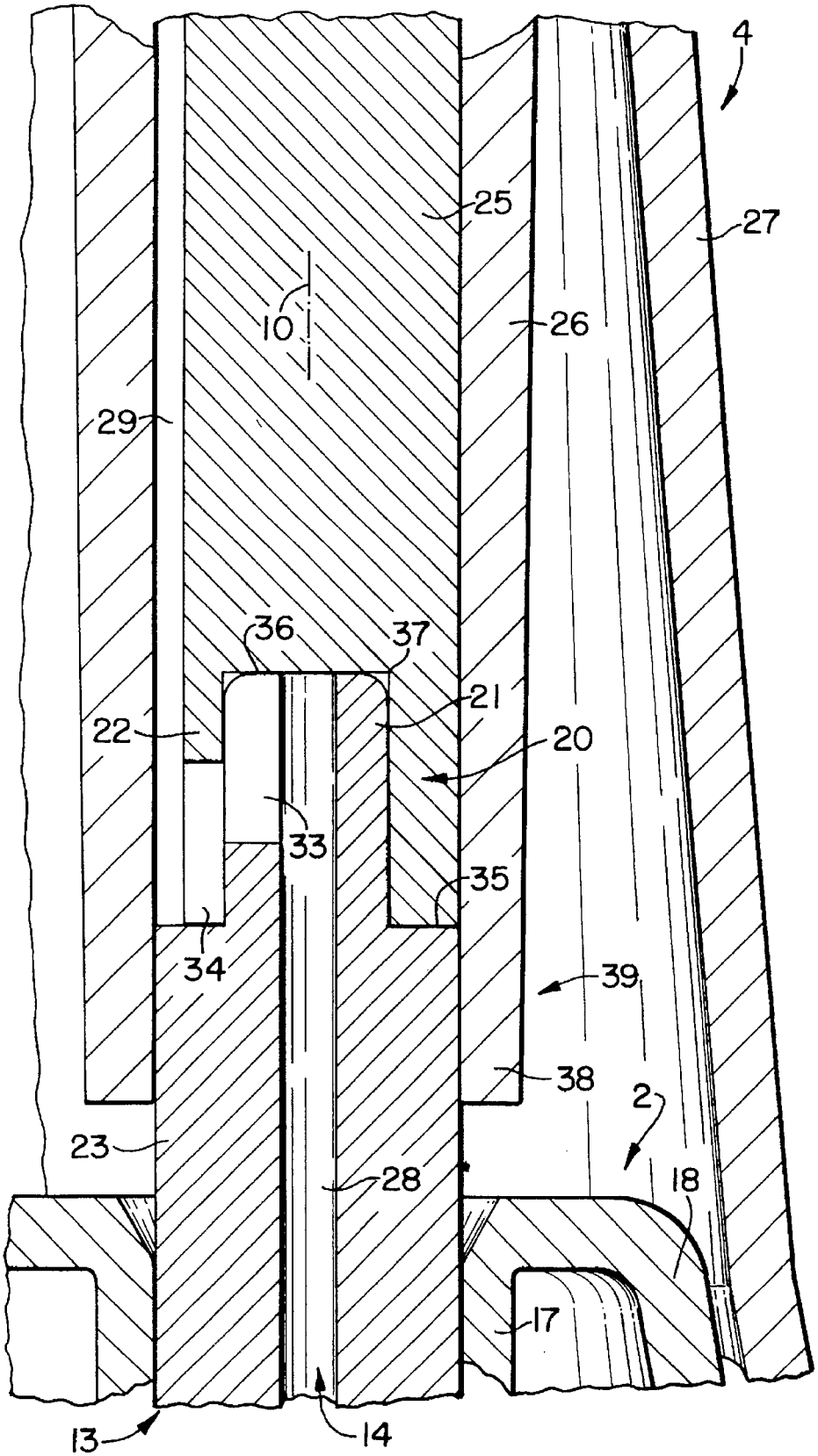

FIG. 2 shows the closed position of the closure 20, in which the passage 33 is located on the side of the closure axis 10 remote from the passage 34, whilst FIG. 3 shows the open position, in which the two passages 33, 34 are in a common axial plane of the axis I0 in that the closure part 22 has been rotated with respect to the components 3, 5, 6, 11, 12, 17, 18, 21 and 23 together with the head 4. Between the medium inlet 15 and the passage 33 on the one hand and the passage 34 and the medium outlet 16 on the other is provided no further valve, overpressure valve, one-way valve, etc., so that the closure 20 forms the sole valve of the outlet channel 14 or the entire discharge apparatus 1.

For rotating the closure parts 21, 22 against one another, according to FIG. 2 the head has on the outer circumference and substantially directly connected to the casing 3 on two remote sides handles 40 for the two fingers of a hand. These handles 40 can be formed by two approximately plane-parallel projection s or gripping surfaces tangential to the outer circumference. The counterhandle 41 for securing said components against the rotary movement is formed by the outer circumference of the casing 3 or by its casing cap 19, which in an axial view transversely to the axis 10 is elongated, but preferably elliptically flat oval, so that the two handle arms constructed as hollow bodies and projecting roughly radially on either side of the axis 10 are formed as the radially outermost boundary of the discharge apparatus 1. Far actuating the discharge feeder or the pump 5 there are two separate handles 43, 44, which are formed on the one hand by the casing 3 and on the other, completely countersunk therein, by the outside of the bottom of the subassembly containing the medium reservoir 6.

The casing cap 19 forming the widest radial extension of the apparatus 1 has a planar front wall 44 passing in one piece into the jacket of the carrying body 18 and with respect to said wall in only a single direction has in projecting manner a onepiece connecting jacket 45, both of which have a non-rotationally symmetrical shape and whereof the jacket 45 forms the handle 41. The end of the jacket 45 remote from the front wall 44 is open substantially to its full remaining width and the outside of the front wall 44 forms on either side adjacent to the head 4 and only between the latter and the narrow ends of the casing 3 two pressure faces as a handle 42. In one or both longitudinal sides of the jacket 45 and spaced from the front wall 44 are provided finger engagement openings 46, which extend up to the open end of the jacket 45 projecting oppositely to the head 4 from the front wall 44. In the starting position the handle 43 is displaced with respect to the end of the engagement openings 46 facing the handle 42 towards the open end thereof, which also applies for the associated end face of the piston 11.

If the index and middle fingers are applied to the handle 42 and the thumb of the same hand to the handle 43, then by means of the thumb the medium reservoir 6 can be moved axially towards the handle 42 or the head 4 with respect to the body 2 until the bottom 8 strikes against the piston 11 and the storage zone has been completely emptied through the outlet channel 14 and the medium outlet. The open end of the medium reservoir 6 provided with a projecting, circular outer collar and which already in the starting position engages in the opening of the front wall 44 or outer cap 18, migrates further into said cap 18 and at the end can strike against its acute-angled, conically tapering inner face, so that the medium reservoir 6 is fixed against withdrawal movements not only by the barb-like acting piston lips 12. The medium filling of the reservoir 6 is appropriately such that the channel portion 28 and passage 33 are also filled in bubble-free manner with liquid or the like, in order to completely exclude inclusions of air or other gases. In the closed state the outlet opening of the passage 33 is tightly closed by the inner circumference and the inner end face of the closure part 22. In the starting position the reservoir 6 or the handle 43 are located completely and in spaced manner from the open end within the jacket 45.

The head 4 which is much longer than the outer jacket 18 surrounds with its end open to its full internal width and which is remote from the outlet end the outer jacket 18 in contact-free manner over its entire length and with gap spacing and can be axially supported with its circular end face on the outside of the front wall 44. On the end wall 44 of the casing 3 the head 4 is mounted in rotary, clearance-free, axial and radial manner with a plain bearing 47. This bearing 47 has a sleeve-like bearing flange, projecting outwards in one piece with the front wall and spacedly surrounding the jacket of the outer cap 18 and in its inner circumference engages the end of the outer jacket 27 in such a way that it is only located between said bearing flange and the jacket of the outer cap 18. The bearing flange constructed in one piece with the outer cap 18 and forming therewith a frontally open circular groove is also used for securing against pulling out of the head casing which is hollow over most of its enclosed volume from the casing 3, e.g. in that in the, case of a plug fitting of the head 4 directed against the outside of the casing 3 a snap or catch connection locks between the radially resilient, elastic snap or catch element of the bearing flange and a counter element, e.g. a circumferential groove on the outer circumference of the head 4. This snap connection can also be a stop member 48 so that the closure 20 is stop-limited in the open and/or closed position and the rotary movement between these positions can be approximately 180°.

According to FIG. 1 the medium reservoir 8 is arranged in a plastic or similar cup-shaped protective casing in axially and rotation secured manner by press fit and forms with its bottom engaging on the bottom 8 the handle 43, is constructed in one piece and can be contact-free with respect to the body 2 in the starting and/or actuating end position. The outer jacket 27 is constructed in one piece with the front wall 44 of the casing 3 and in it the protective casing 49 can engage in the end position described relative to FIG. 2 in the same way as the reservoir 6. The handle 40 projects radially on the outer circumference of the protective casing 49 and is in one piece there-with. In the stroke starting position the handle 40 is completely within the casing 3 and in the closed and/or open position of the closure 20 is in a median or axial plane of the casing 3 or axis 10 roughly parallel or at right angles to the radial longitudinal direction of the casing 3.

The plate-like handle 40 projecting opposite to the jacket of the casing 49 or some corresponding member can act as a lock, which positively prevents a pumping movement, for as long as the closure 20 has not opened. For example the corresponding edge of the handle 40 can strike against the end or locking edge 50 of the engagement opening 46 closest to the front wall 44. However, it can also strike at the end of the pump stroke against said locking edge 50. The handle 40 at the same time forms an indicator of an indicating device 51 on which the position of the closure 20 and/or the stroke state of the pump 5 can easily be recognized from the outside. According to FIG. 2 the handle 40 can also be provided on the medium reservoir 6, so that the latter is rotated with respect to the body 2 or its two components 3, 4 for actuating the closure 20. By means of the piston lips 12, the piston 11 and the shaft part 23, the reservoir 6 then carries non-positively with it in the rotation direction the closure part 21 with respect to the casing-fixed closure part 22 and the remaining body 2, so that the closure is actuated. When the closure 20 is open the described pump stroke movement is performed, so that the medium is forced through the outlet channel 14 and the medium outlet under an overpressure.

In the embodiment according to FIG. 1 the carrying sleeve 26 can pass from the free end of the head 4 in one piece into the reservoir 6, so that it is constructed in one piece with the carrying sleeve 17 and the outer cap 18 is unnecessary.

Figure 4:
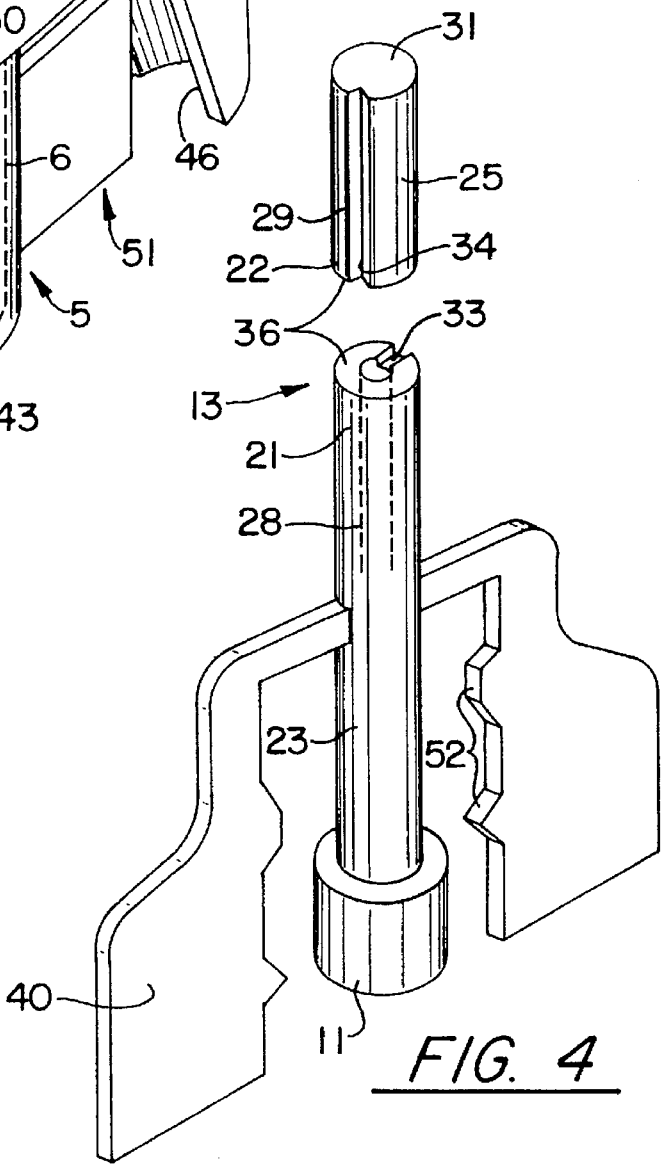

According to FIG. 4 the plate-like and angular handle 40 is provided on the outer circumference of the shaft part 23, to which it is connected with the end of a more slender angle side, whereas the other angle side projects freely in the same direction as the piston 11 and forms the gripping surface of the handle 40. This ensures a direct, forced or positive driving of the closure part 21 by rigid connection with the handle 40 and the non-rotation-secured reservoir 6 can freely rotate without any change to its operating position. The two closure parts 21, 22 are directly connected to one another by their facing, outermost, planar and equally wide front faces 36 and around the end of the channel portion can be provided a sealing lip, a projecting sealing cone, etc. The upstream end of the channel portion 29 is directly connected to the front face 36 of the closure part 21 radially outside the channel portion 28, so that it is only in line connection with portion 28 in the case of orientation with the passage 33, but in all other positions is tightly closed with respect to the portion 28 by the front face of the closure part 21, Thus, the front face 36 of the filler 25 requires no depression 37.

The reservoir located with its jacket between the handle 40 and the outer circumference of the shaft part 23 or the piston 11 can in the pump end position strike with its open end on the fixing legs of the handle 40. On the longitudinal edges of the handle 40 facing said circumference are provided projecting cams 52, which in the stroke position are in spaced succession and on which the reservoir 6 or the protective casing 49 can strike with a corresponding counter member, e.g. its open end following a partial stroke, so that the discharge of a partial quantity of the total medium quantity stored is ensured. By a correspondingly increased compressive force against the reservoir 6 the cam locking is overcome in that the handle 40, accompanied by bending deflection of its fixing leg, is resiliently radially outwardly deflected and permits the snapping passage of the counter member, e.g. the outer collar of the reservoir 6, after which the reservoir 6 at the end of its further partial stroke correspondingly strokes against the next cam 52.

In the embodiment according to FIG. 1 the closure parts 21, 23 or 22, 25 are inserted in the carrying sleeve from the open end of the casing 3 and the head 4, after which the medium reservoir 6, optionally already in a preassembled state with the casing 49 is engaged in the same direction on the piston 11 and the carrying sleeve with at least a third of its length. The reservoir 6 can already be filled and appropriately during the engagement the closure 20 is open for venting through the medium outlet 16 and is only closed when the medium has at least partly filled the channel portion 28 or up to the passage 33. Fitting is much the same in the case of the embodiment of FIG. 4.

In the embodiment according to FIGS. 2 and 3 the shaft part 23 is inserted in the described manner in the carrying sleeve 17 until its end containing the closure part 21 projects freely out of the casing 3 or the outer cap 18. Then, as described, the filled reservoir 6 can be engaged and the filling of the channel portion 28 is visible through the outflow of the medium at the free passage 33, because the closure part 22 or the head 4 has not yet been fitted. The latter is engaged in the opposite direction following the prefitting with the components 22, 25 until it snaps into the bearing 47. The closure parts 21, 22 in their reciprocal closing orientation can be axially engaged with one another, so that an opening of the closure 20 for venting and a subsequent closing of the closure 20 as in the embodiments of FIGS. 1 and 4 is unnecessary. Apart from the passages 32 to 34, the flow control 30, the handle 40 and the stop 48 all the other arrangements and components can be axially or rotationally symmetrical to the axis 10. The closure 20 according to the invention, particularly in an embodiment according to FIG. 1, can be subsequently fitted to existing bodies 2 or medium reservoir 6, which are provided for shaft parts 23, 25, which pass in one piece from the piston 11 or to the end 31 or are not movable against one another. Each of the components can be a plastic injection moulding.

We claim:

1. A dispenser for discharging media from a medium reservoir (6) out of a medium outlet (16), said dispenser (1) comprising:

a basic body (2)

an outlet channel (14) having channel sections including a closure section (33, 34), a channel inlet for connecting to the medium reservoir (6) and a channel outlet, for connecting to the medium outlet (16), said outlet channel (14) having outlet cross-sections;

a discharge actuator determining an actuating direction manually driving the medium through said outlet channel (14), and a closure (20) for varyingly constricting said outlet channel (14), said closure (20) being transferrable between at least two closure positions including a constricted position and an open position less constricted than said constricted position, said closure (20) including first and second closure members (21, 22) manually reciprocally movable to provide said closure positions, wherein said closure (20) and said outlet channel (14) are provided on an outlet shaft (13).

2. The dispenser according to claim 1, wherein said outlet shaft (13) extends between shaft sections including end sections, said end sections including an inlet end and an outlet end, said outlet shaft (13) extending over a shaft length extension, said closure (20) being spaced from at least one of said shaft ends, both said shaft ends being circumferentially narrowly enveloped in the vicinity of circumferential seals.

3. The dispenser according to claim 1, wherein for operating said closure (20) at least one closure handle (40, 41) separate from said discharge actuator and said outlet shaft (13) is provided, at least one of said closure handle (40, 41) being located spacedly upstream of said channel outlet, at least one of said closure handle (40, 41) extending radially away from at least one of said channel sections.

4. The dispenser according to claim 1, wherein said dispenser (1) defines a main center axis (10), said discharge actuator being operably displaceable with respect to said center axis (10), for operating said closure (20) at least one closure handle (40) being provided and movable over a motion path, along which said at least one closure handle (40, 41) has a substantially constant radial spacing from said center axis (10).

5. The dispenser according to claim 1, wherein said shaft sections provide separate first and second shaft portions (23, 24) reciprocally displaceable for operating said closure (20), at least in said constricted position said shaft portions (23, 24) being substantially coaxial.

6. The dispenser according to claim 5, wherein said shaft portions are adjacent each other.

7. The dispenser according to claim 2, wherein at least a partial length section of said outlet shaft (13) provides an actuator shaft (13) of said discharge actuator, said outlet end being entirely enveloped and encapsulated so as to be accessible only via said outlet channel.

8. The dispenser according to claim 2, wherein at least in said open position said outlet end is covered by an inside face of an end wall having an outside face, said outside face being traversed by said medium outlet (16).

9. The dispenser according to claim 1, wherein in a same length section at least one of said channel sections (23) is circumferentially bounded by at least two separate bounding members (13, 26) including said outlet shaft, at least one of said bounding members having a circumferential bounding face for bounding only part of said at least one channel section.

10. The dispenser according to claim 1, wherein said closure section is bounded by at least three to nine reciprocally radially and axially offset bounding faces including at least one concave circumferential face, at least one convex circumferential face and at least one radially extending end face (35, 36), said bounding faces being provided by at least three separate bounding members (23, 25, 26) including said outlet shaft (13).

11. The dispenser according to claim 2, wherein in at least one of said closure positions said outlet end is oriented at least axially parallel and at the most coaxial with said inlet end, at least one of said channel sections (23, 24) being operably axially displaceable with respect to the medium reservoir (6).

12. The dispenser according to claim 2, wherein said outlet shaft (13) provides a piston unit including at least one pump chamber constrictor (11), at least one of said shaft sections (23) being made in one part with at least one of said pump chamber constrictor (11).

13. The dispenser according to claim 1, wherein said medium outlet (16) traverses an end wall and provides an outlet nozzle, said outlet end directly connecting to said end wall and providing a nozzle core.

14. The dispenser according to claim 1, wherein said basic body (2) provides a freely projecting outlet stud (4) including an external stud jacket (27) and an internal stud jacket (26) located spacedly within said external stud jacket (27), said internal stud jacket sealingly enveloping at least one of said channel sections.

15. The dispenser according to claim 1, wherein said closure members (21, 22) are sealingly enveloped by at least one jacket (26, 27).

16. The dispenser according to claim 14, wherein said external stud jacket (27) projects over a free end of said internal stud jacket (26), said external stud jacket (27) being oblong and longer than said internal stud jacket (26).

17. The dispenser according to claim 2, wherein at least one of said shaft sections (23, 25, 26) including said outlet end is positionally substantially rigidly connected to said basic body (2) against at least one of relative motions defined by axial motions, radial motions and rotational motions.

18. The dispenser according to claim 2, wherein at least one of said shaft sections (23) including said inlet end is closely enveloped by a supporting sleeve (17) freely projecting towards said inlet end.

19. The dispenser according to claim 18, wherein at least in said constricted position said supporting sleeve (17) is spacedly enveloped by a supporting jacket (18) projecting into an open end of an external stud jacket (27) of an outlet stud.

20. The dispenser according to claim 2, wherein at least one of said closure members (21, 22) is rigidly and dimensionally stable connected to at least one of said shaft sections, said closure members (21, 22) being reciprocally connected by a plug connection oriented at least axially parallel and at the most coaxial with at least one of said shaft sections.

21. The dispenser according to claim 1, wherein said second closure member (22) is rigidly connected to an outlet end of said outlet shaft (13), at least one of said closure members (21, 22) being radially traversed by said closure section (33, 34).

22. The dispenser according to claim 21, wherein at least one of said closure members (21, 22) has an end face (35, 36), said closure section (33, 34) connecting to said end face of at least one of said closure members (21, 22).

23. The dispenser according to claim 1, wherein said closure section (33, 34) is provided by a first subsection (23) and a second subsection (34) connecting downstream to said first subsection, said subsections (33, 34) reciprocally overlapping along said outlet shaft (13).

24. The dispenser according to claim 2, wherein for operating said closure (20) said outlet end and said inlet end are reciprocally movable, said outlet end thereby being movable common with said basic body (2).

25. The dispenser according to claim 1,.wherein said basic body (2) provides two body components (3, 4) reciprocally movable for operating said closure (20), at least in said constricted position said closure members (21, 22) being sealingly enveloped by a reception member (26) separate from at least one of said closure members providing an upstream closure member (21).

26. The dispenser according to claim 1, wherein for operating said closure (20) at least one closure handle (40, 41) is provided, said outlet shaft (13) providing an outlet end separate from said at least one closure handle (40, 41), said at least one closure handle (40, 41) being separate from said closure members (21, 22).

27. The dispenser according to claim 1, wherein for operating said closure (20) at least one closure handle (40, 41) is provided, at least one of said closure handle (40, 41) being a freely projecting handle lever separate from said outlet end and from at least one of said closure members providing a downstream closure member (22).

28. The dispenser according to claim 1, wherein for operating said closure (20) at least one closure handle (40, 41) is provided, at least one of said closure handle (40) being located in substantially countersunk within a casing (3).

29. The dispenser according to claim 1, wherein for operating said closure (20) at least two closure handles (40, 41) including an external handle (41) and an internal handle (40) are provided, said external handle (41) extending further away from at least one of said channel sections than said internal handle (40), when a user's hand holds said dispenser (1) on said external handle (41) said internal handle (40) being accessible from one end of this hand for actuating.

30. The dispenser according to claim 1, wherein for operating said closure (20) at least one closure handle (40, 41) is provided at least one of said closure handle (40) being provided for rigid connection with the medium reservoir (6) and providing a handle projection.

31. The dispenser according to claim 1, wherein at least one closure handle (40, 41) for operating said closure (20) is located radially spacedly outside a reservoir unit provided to holdingly receive at least one of a medium container (6), and the medium prior to assembling said reservoir unit with said basic body (2), at least one of said closure handle (41) being operationally movable along an outside of said reservoir unit.

32. The dispenser including said medium reservoir (6) according to claim 1, wherein for discharging the medium a reservoir unit including said medium reservoir (6) is displaceable with respect to said basic body (2) and provides a pressure chamber, said pressure chamber being dimensionally substantially stable and volumetrically variable for pressurizing the medium towards said closure (20).

33. The dispenser according to claim 32, wherein for pressurizing the medium said reservoir unit (6) is axially displaceable with respect to said basic body (2), an inlet end of said outlet shaft being displaceable substantially up to a bottom wall (8) of said medium reservoir.

34. The dispenser according to claim 1, wherein in said constricted position said closure (20) sealingly closes said outlet channel (14) with pretension, thereby providing a barrier against escape of evaporating medium out of the medium reservoir and said outlet channel (14), said inlet end (11, 12) being provided for sealingly closing the medium reservoir (6) with at least one piston (11) operationally displaceable with respect to the medium reservoir.

* * * * *